US007121548B1

(12) United States Patent
Heltzinger

(10) Patent No.: US 7,121,548 B1
(45) Date of Patent: Oct. 17, 2006

(54) BOARD GAME HAVING MAGNETICALLY ATTRACTIVE GAME

(76) Inventor: Agnes M. Heltzinger, 27101 Delaine Landing Rd., Philadelphia, PA (US) 19114

( * ) Notice: Subject to any disclaimer, the term of this patent is extended or adjusted under 35 U.S.C. 154(b) by 0 days.

(21) Appl. No.: 11/286,002

(22) Filed: Nov. 23, 2005

(51) Int. Cl.
*A63F 3/00* (2006.01)

(52) U.S. Cl. ..... 273/239; 273/283; 273/287

(58) Field of Classification Search ..... 273/239, 273/283, 287
See application file for complete search history.

(56) References Cited

U.S. PATENT DOCUMENTS 4,986,546 A * 1/1991 Cerulla ..... 273/240
5,398,938 A * 3/1995 Money ..... 463/61

* cited by examiner

*Primary Examiner*—Vishu Mendiratta
(74) *Attorney, Agent, or Firm*—Volpe and Koenig, P.C.

(57) ABSTRACT

A game having a game board with internally guided permanent magnets for magnetically attracting game pieces slidable along tracks on the game board. The game board may be made into sections which are joined using reinforcing rods force-fittingly inserted into hollow internal portions of the game board.

The number of players is independent of the number of game pieces. The game pieces may be changed to play different game such as a car race, horse race, boat race and the like.

13 Claims, 5 Drawing Sheets

BOARD GAME HAVING MAGNETICALLY ATTRACTIVE GAME

FIELD OF INVENTION

The present invention relates to board games and more particularly to a board game in which the game pieces engage in a race and are magnetically attracted to the board.

BACKGROUND

Board games typically utilize game pieces which are freely movable on the board. Things which jostle the board may cause disruption of the positions occupied by the game pieces.

SUMMARY

The present invention is characterized by comprising a game board which, while having a relatively smooth upper surface defining tracks for the game pieces, is provided with hollow channels along the undersurface of the game board which slidably receive and guide magnetic members that are magnetically attractive to either another magnetic member or a ferromagnetic member slidable along each track and serving as a support for the game piece.

In addition to the game pieces and game board, three individual dies are provided and are thrown by each player or by one designated player to determine which game pieces move and the number of spaces moved by the game piece or pieces. The dice accommodate up to eight game pieces and further provide for other possible events such as no move, moving back a space or moving double the amount of the spaces called for on the die having the numerals representing the number of spaces to be moved. Thus, the game is unique in that the throw of the dice may advance game pieces which are independent of the player throwing the dice.

The game may be played utilizing different sets of game pieces such as race cars, race horses, racing dogs, such as greyhounds, or the like.

The game board may be disassembled to provide a compact game kit to facilitate storage and movement of the game when traveling from one place to another.

BRIEF DESCRIPTION OF THE DRAWING(S)

The above as well as other objects of the invention will become apparent from a consideration of the drawings in which like elements are designated by like numerals and, wherein.

Figure 2:
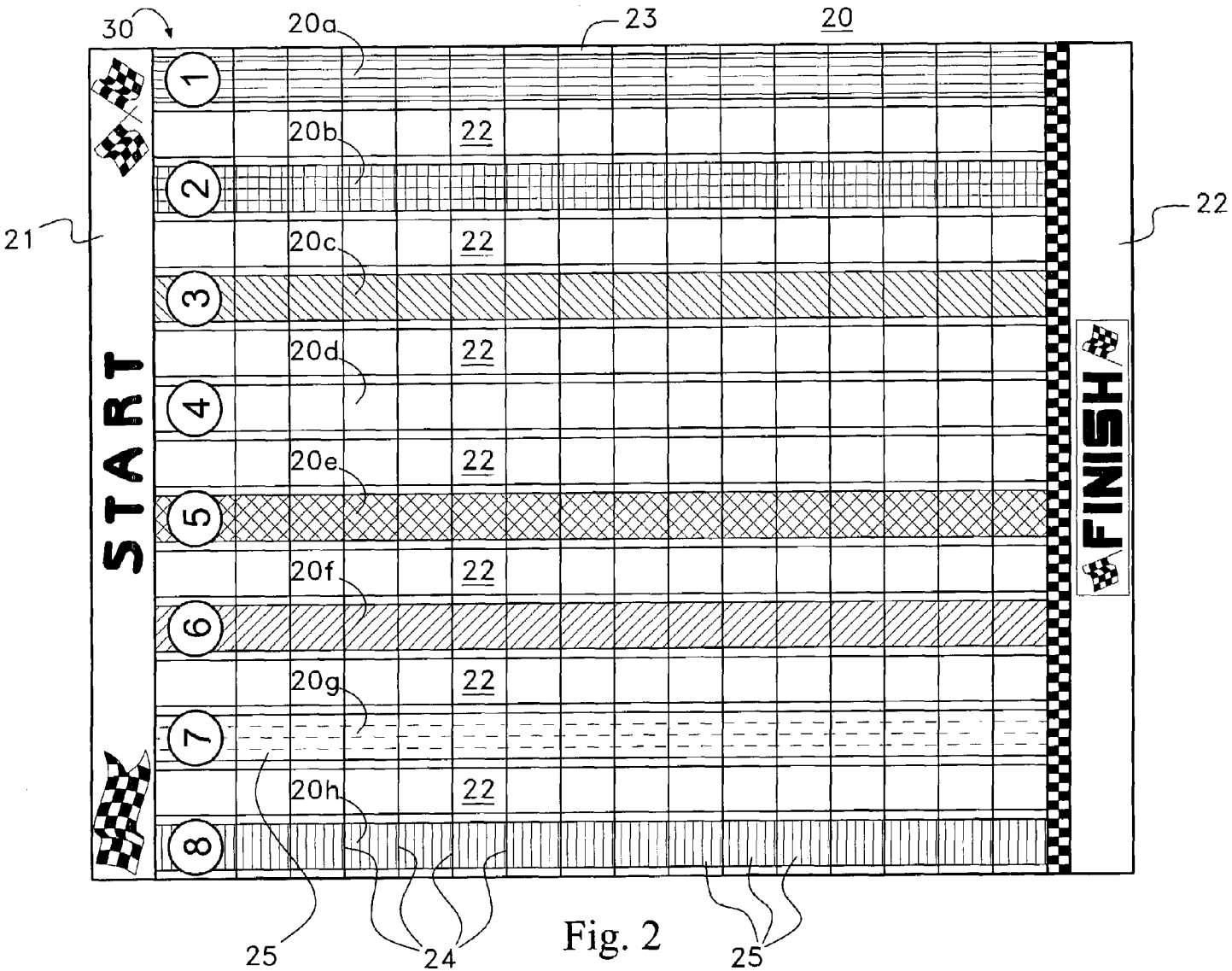
FIG. 2 is a top plan view showing the game board surface in greater detail.
Figure 2A:
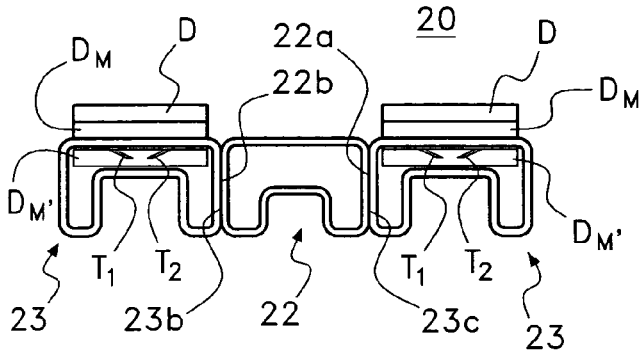
FIG. 2A shows an end view of a portion of the game board of FIG. 2.
Figure 2B:
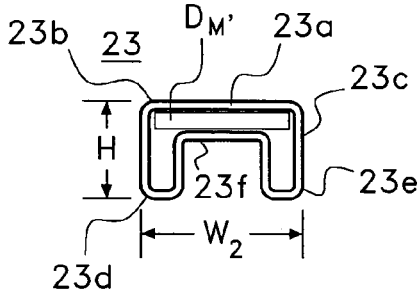
Figure 2C:
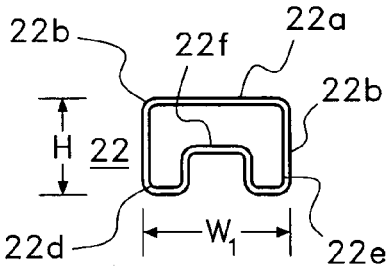

FIGS. 2B and 2C respectively show sectional views of modular type elements utilized to construct the game board of FIGS. 2 and 2A.

Figure 2D:
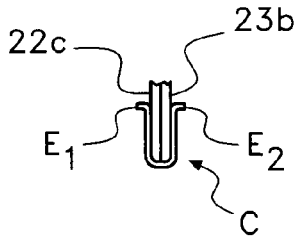

FIG. 2D is a detailed view showing a clip for joining adjacent game board pieces.

Figure 2E:
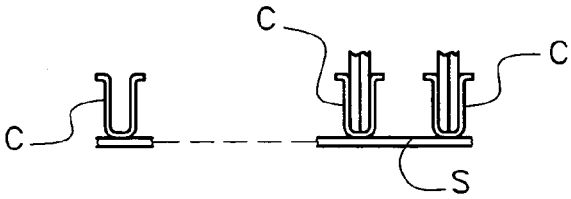

FIG. 2E is a top view of a clip assembly for joining adjacent game pieces.

Figure 2F:
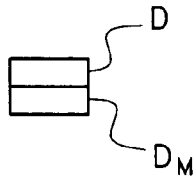

FIG. 2F shows an elevational view of a game piece of the type shown in FIG. 2.

Figure 2G:
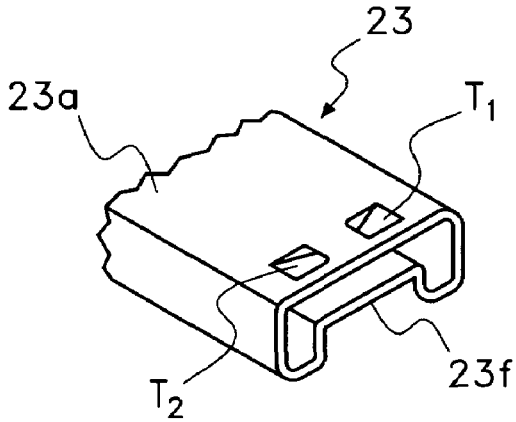
Figure 2H:
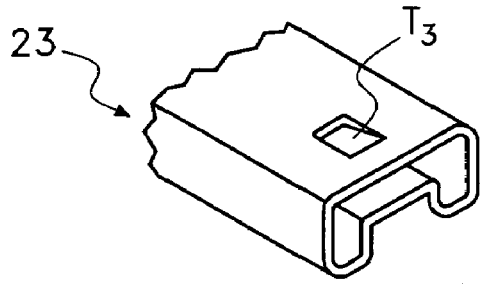

FIGS. 2G, 2H and 21 show alternative embodiments for retaining permanent magnets in the hollow support members.

Figure 2I:
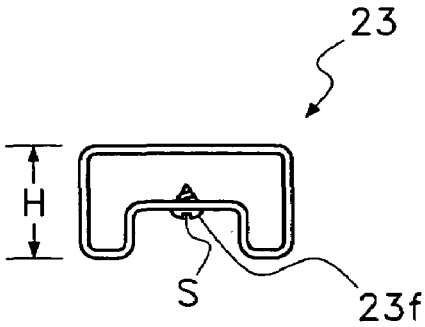
Figure 2J:
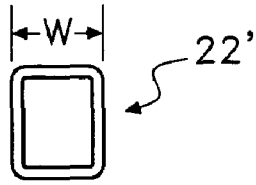

FIG. 2J shows an end view of an alternative spacer member for use in the game board.

Figure 3A:
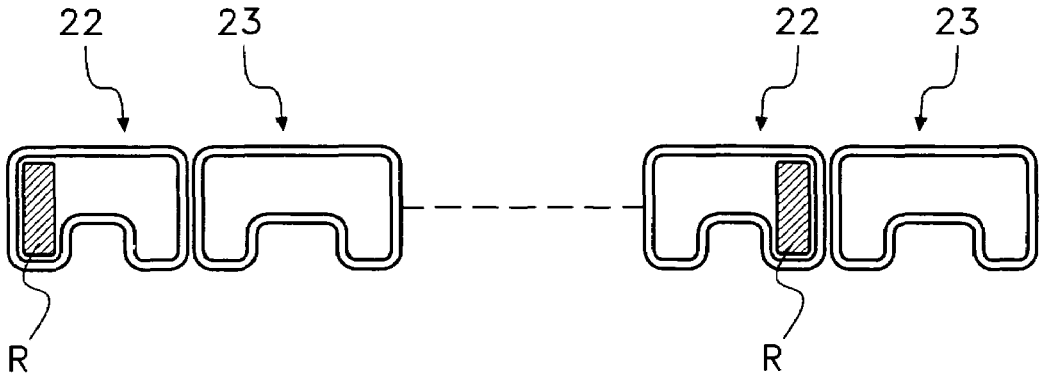
Figure 3B:
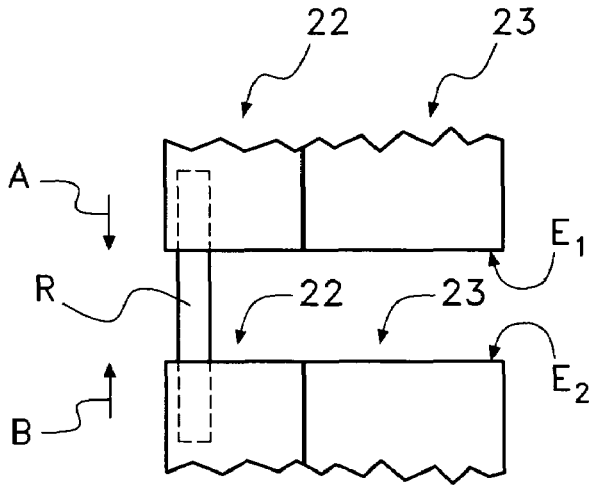

FIGS. 3A and 3B are end and top plan views showing an arrangement for joining a split game board.

Figure 3C:
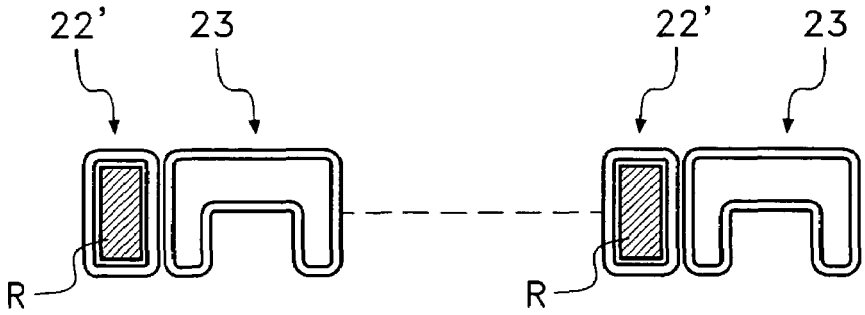

FIG. 3C is an end view of a modified version of the arrangement shown in FIGS. 3A and 3B.

DETAILED DESCRIPTION OF THE PREFERRED EMBODIMENT(S)

Figure 1:
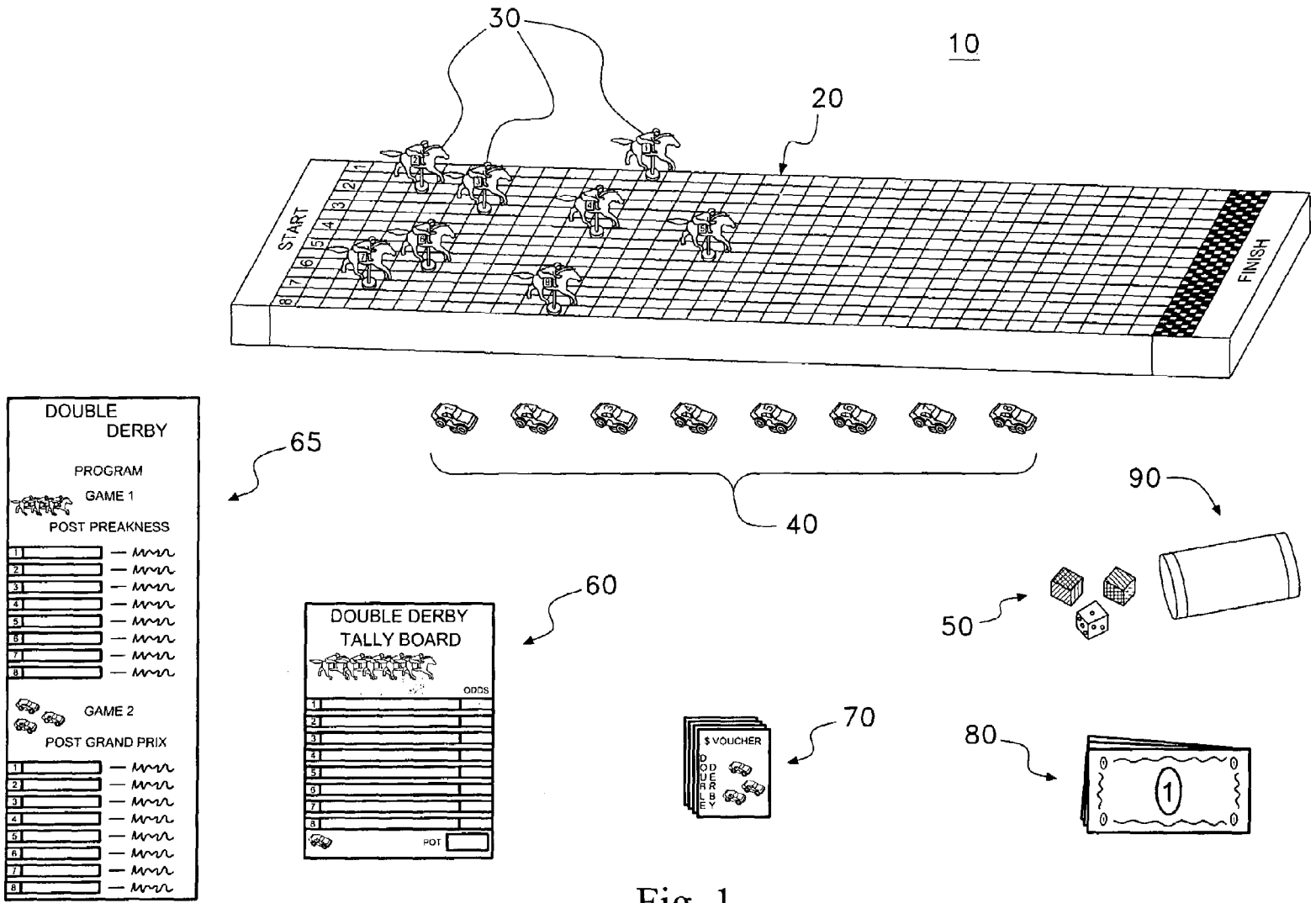
FIG. 1 is a perspective view of a board game embodying the principles of the present invention.

FIG. 1 is a perspective view of a game embodying the principles of the present invention and further showing all of the constituents making up the game. The game 10 is comprised of a game board or playing surface 20, two exemplary sets of game pieces 30 and 40, three dies 50, a tally board 60, a program 65, a plurality of sets of vouchers 70, play money 80 and a cup 90 for rolling the three dice. Different sets of vouchers and a different program and Tally board for each different game, may be provided.

Making reference to FIGS. 1 and 2, the game board 20 has a playing surface shown in detail in FIG. 2. The playing surface is designed to permit participation by up to eight (8) game pieces. Each game piece is preferably of a different color. For example, making reference to the game pieces 30, the game may be played as a horse racing derby. Each horse, i.e., game piece, is of a different color from the other game pieces. Game pieces representing car, horse, boat or foot races may be employed, for example. The game board surface is arranged to provide eight (8) different tracks having a colored strip defining each track, each colored strip being of a color different from the remaining colored strips. The eight colored strips 20*a* through 20*h* extend between the starting line 21 and the finish line 22. Each game piece is positioned along the track of the corresponding color. FIG. 2 shows simplified game pieces 30' which have a circular shape and are preferably circular-shaped disks. A spacer member 22 is positioned between adjacent pairs of tracks there being seven (7) spacer members 22.

Each colored track 20*a* through 20*h* is mounted upon a track supporting member 23. Since all of the track supporting members 23 are substantially identical in design and function and since all of the spacer members 22 are likewise identical in both design and function, only one of each of these elements will be described in detail below for the sake of simplicity. side surfaces 22*b*, 22*c*, two substantially flat bottom surfaces 22*d*, 22*e* and an inverted, substantially U-shaped portion 22*f* Similarly, track support member 23, shown in FIG. 2B has a flat top surface 23*a*, two substantially flat, opposing side surfaces 23*b*, 23*c*, two substantially flat bottom surfaces 23*d*, 23*e* and an inverted, substantially U-shaped portion 23*f*.

The heights H of members 22 and 23 are substantially the same.

FIG. 2B shows an end view of a track support member 23 and FIG. 2C shows an end view of a spacer member 22. The spacer members 22 and track support members 23, in one preferred embodiment, have similar cross-sectional configurations, the difference being the width of these members. More specifically the spacer members 22 have a width $W_1$ which is preferably less than the width $W_2$ of the track support members 23. Making reference to FIG. 2C, the spacer member 22 is a hollow tubular-shaped member having a flat top surface 22*a*, two substantially flat, opposing side surfaces 22*b*, 22*c*, two substantially flat bottom surfaces

22*d*, 22*e* and an inverted, substantially U-shaped portion 22*f*. Similarly, track support member 23, shown in FIG. 2B has a flat top surface 23*a*, two substantially flat, opposing side surfaces 23*b*, 23*c*, two substantially flat bottom surfaces 23*d*, 23*e* and an inverted, substantially U-shaped portion 23*f*.

The heights H of members 22 and 23 are substantially the same.

The game board is constructed by joining adjacent side surfaces of members 22, 23. For example, FIG. 2A shows a spacer member 22 positioned between left and right-hand track support members 23, 23. Once preferred technique is to join the right-hand side surface of spacer member 22 to the left-hand side surface 23*b* of the right-hand track support member 23. Similarly, the left-hand side surface 22*b* of spacer member 22 is joined to the right-hand side surface 23*c* of the left-hand track support member 23. These aforementioned surfaces may be joined using a glue, cement or epoxy, for example, which does not deteriorate or degrade the tubular plastic members 22 and 23 and which provides a suitable bond therebetween. The remaining track support members 23 and spacer members 22 are joined in a like fashion.

As an alternative, and in an effort to make the game board more compact when not in use, the opposite ends of each track support member may be joined to an adjacent spacer member 22 by springy, flexible clips such as clip C, shown in FIG. 2D as embracing engaging sides 23*b*, 22*c* of adjacent track support member 23 and spacer member 22. Clips C are preferably provided at each end of the game board, each clip C have curved open ends E1, E2 to facilitate insertion of engaging sides of adjacent track support members and spacer members.

As a further alternative, the clips may be integrally joined to an elongated strip S shown in FIG. 2E. In the embodiment of the game board shown in FIG. 2 and having eight (8) track support members and seven (7) spacer members, fourteen (14) clips C are integrally joined to a common elongated strip S and the clips may be snapped into place either one at a time or simultaneously. A strip S having integral clips C is placed at both ends of the game board to secure the members 22, 23 together.

Each game piece such as the disk-shaped game pieces 30' shown in FIG. 2, is comprised of a colored disk D which may, for example, be a suitable plastic material joined to a disk-shaped magnet $D_M$ by any suitable adhesive. The colors of each disk correspond to a color of one of the tracks.

Each of the track support members 23 has a disk-shaped permanent magnet member $D_{M'}$ positioned within the tubular-shaped member and resting on the surface 23*f* and between sides 23*f* and top 23*a*. The permanent magnets $D_{M'}$ are slidable within each track support member 23 wherein both the permanent magnet member $D_{M'}$ and the tubular, plastic track support members 23 have surfaces which provide a low coefficient of sliding friction to assure substantially free sliding movement of the permanent magnet $D_{M'}$ within each tubular member 23.

All of the permanent magnets $D_{M'}$ within track support members 23 may be moved to the starting end of the game board 20 by tilting the game board to an angle sufficient to cause the permanent magnet members $D_{M'}$ to slide down to the end of the game board which constitutes the start location. The game board may then be returned preferably to a substantially horizontal orientation.

Each game piece is positioned on the game board 10 so that the color of the disk-shaped member D matches the corresponding color of the associated track 20*a* through 20*h*.

Assuming that a game piece is to be advanced along its track by a given distance, any player slides the game piece away from the starting line and toward the finish line by a number of spaces determined by the throw of the three dice. Due to the magnetic attraction between the permanent magnet members $D_M$ and $D_{M'}$, the member $D_{M'}$ is slidably moved in the same direction and by substantially the same distance that the associated game piece is moved, due to the magnetic attraction therebetween. Although the embodiment described uses cooperating and mutually attractive permanent magnets, as an alternative, one of the cooperating permanent magnets may be a metal or metallic composition which is attracted to a magnet or to a sheet of the same result. Either of the permanent magnets $D_M$ and $D_{M'}$ may be substituted by a member which is attracted to a permanent magnet, dependent only upon the preferences of the user.

Marker strips 24 are placed across the top surfaces of the spacer members 22 and track support members 23 to define spaces 25 of constant length in order to facilitate counting of the number of spaces a game piece is advanced.

In order to prevent the permanent magnet members $D_{M'}$ from falling out of the ends of the track support members 23, as one example, a suitable resilient member may be force-fitted into each end of members 23 after the permanent magnet members $D_{M'}$ are inserted into each track support member 23. As an alternative technique, the upper surface 23*a* of each track support member 23 may be pierced by a suitable piercing tool to form two tabs $T_1$, $T_2$ which are diagonally aligned so as to extend downwardly and into the path of movement of the permanent magnet member $D_{M'}$ by an amount sufficient to prevent the permanent magnet member from passing tabs $T_1$ and $T_2$ and thereby falling out of the track support member 23. Tabs $T_1$, $T_2$ are preferrably formed at opposite ends of each track support member after insertion of the permanent magnet members $D_{M'}$. As an alternative, the tabs may be pierced so as to extend upwardly from the surface 23*f*, if desired. As a further alternative, a single tab may be formed as shown as FIG. 2H wherein a suitable piercing tool is utilized to form a tab such as, for example, the tab $T_3$ which extends diagonally downward and protrudes into the path of movement of the permanent magnet member $D_{M'}$ by an amount sufficient to prevent the permanent magnet from escaping from the track support member 23.

As a further alternative, a self-tapping threaded member such as a self-tapping screw S, shown in FIG. 2I may be screwed into surface 23*f* and is preferably of a height sufficient to block the permanent magnet member $D_{M'}$ from escaping from the tubular member 23.

The spacer member 22 is not limited to the cross-sectional configuration shown in FIG. 2G and may alternatively have a rectangular-shaped cross-section as shown by embodiment 22' in FIG. 2J. However, similar to the embodiment 22 shown in FIG. 2C, the width $W_1$ of spacer member 22' is preferably less than the width W of the track support member 23 shown in FIG. 2B and is preferably although not necessarily the same height as the track support member 23 but may, if desired, have a height H' which is less than the height H of the track support member 23. Alternatively, the height of each spacer member may be greater than the height of the track support members to limit lateral movement of the game pieces along their respective tracks.

The track support members 23 and spacer members 22 are preferably formed of a substantially transparent plastic material or alternatively are formed of a material having a neutral color to provide suitable contrast between the exposed areas of these members and the strips 20*a* through 20*h* which serve as the tracks for each of the player pieces.

Although the preferred embodiment provides a game board having tracks for up to eight game pieces, it should be understood that a greater or lesser number of tracks may be added. However, this will require an additional die as will be explained below. In addition, whereas the length of the preferred embodiment shown in FIGS. 1 and 2 is preferably of the order of 32 inches, the game board may be greater or lesser in length, if desired.

In addition, in order to make the game board more compact, the game board may be split into two halves or three thirds, for example, and several rods may be inserted into selected ones of the spacer members. For example, making reference to FIG. 2, the spacer members 23 between tracks 1 and 2, 4 and 5 and 7 and 8 may each receive one-half a length of a rod. Making reference to FIGS. 3A and 3B the spacer members 22 shown in FIG. 3A each receive a portion of a reinforcing rod R which preferably conforms to a shape of one interior side of the spacer member. The reinforcing rod has a configuration and size relative to the interior of the hollow member receiving the rod so as to be force-fittingly received within the area of the spacer members 22 shown in FIG. 3A. Making reference to FIG. 3B, the reinforcing rod is shown partially inserted into sections of the game board to be joined. The reinforcing rod R is force-fitted into the portions being joined and these portions are moved toward one another as shown by arrows A and B until adjacent edges $B_1$, $B_2$ abut one another. It should be understood that the reinforcing rods R are of a length sufficient to hold the joined sections of the game board substantially rigid. In addition, the reinforcing rods R are preferrably no greater in length than the length of each sectionalized portion of the game board.

FIG. 3C shows a sectional view of a game board embodiment utilizing the spacer member 22'. In this embodiment a reinforcing member R similar to the arrangements shown in FIGS. 3A and 3B has a shape conforming to the interior shape of the spacer member 22' and is force-fittingly inserted so as to provide a friction fit between the reinforcing member R and the spacer member 23'. As shown in FIGS. 3A through 3C, interlocking reinforcing members are provided in selected ones of the seven (7) spacer members, a greater or lesser number of reinforcing members R.

In the embodiments in which the game board is divided into sections as described above, the permanent magnet members are preferrably stored within a box or cabinet which stores all of the components of the game and reinserted at the time that the game board sections are joined using the reinforcing members R.

Cooperating permanent magnets or permanent magnets and magnetically attractive ferromagnetic members are employed to retain each of the game pieces in position unless and until they are moved by one of the players making the game of the present invention advantageous for use in any environment including out of doors, at the beach, etc. since the game pieces will not be disrupted by accidental jostling or tilting of the game board.

It should be noted that the game board has flexibility in that a number of different types of game pieces may be utilized. As noted in FIG. 1, the game may be utilized as a horse race where the game pieces resemble horses and their riders with permanent magnets affixed to the base of each game piece. Alternatively, the game may be played as an auto race wherein the game pieces 40 resembling race cars are likewise provided with either a permanent magnet member or a magnetically attractive material coupled to the underside of each game piece. Obviously other types of game pieces may be employed.

The object of the game utilizing the game pieces of the present invention is to win the largest bet as a game piece crosses the finish line. This is accomplished by rolling of the dice. Three six-sided dies are provided, two of which are color coded to correspond to the colored tracks on the game board while the third die is a number die, preferably having 1 through 6 dots. The color coded dice each have four different colored surfaces with a fifth surface on each die marked "Double Derby". A remaining sixth side surface on one of the dies is marked "No Go". A remaining surface on the remaining die is marked "Muddy". All three dice are rolled together. The color that turns up determines the game piece to be moved and the number die determines the number of spaces to move the game piece corresponding to that color. In the event that "double derby" turns up on one die and a color turns up on the other die then the number which turns up on the number die is doubled and the game piece of the corresponding color moves double the number of spaces shown on the number die. If "double derby" turns up on both dice then every game piece moves one space and one space only regardless of the number that turns up on the number die. If "no go" turns up with a colored die that game piece cannot move. If "muddy" turns up with one colored die that game piece moves back one space. If more game pieces and tracks are used, a fourth six-sided die may be added with up to six (6) additional colored sides.

As some examples:

If blue and red and three are rolled, blue and red move three spaces.

If "double derby" and green and four are rolled, the green game piece moves eight spaces.

If "double derby" appears on both dice and the number 2 is rolled, all of the game pieces move forward one space. The number die is ignored.

If "no go" and yellow and five are rolled, the yellow game piece cannot move during that throw of the dice.

If "muddy" and orange and six are rolled, the orange game piece moves six minus one spaces or a total of five spaces forward.

If "no go" and "muddy" and three are rolled, no game pieces can move (since no color appeared).

Two or more players may participate in a game, each taking his or her turn to roll the dice. Game pieces are lined up at the starting line. The number of players is unlimited and is independent of the number of game pieces.

One player is preferably chosen to administer the vouchers and keep the tally board and one player distributes the money. Each player receives a set amount of each denomination according to the following chart:

| Denomination | Number of Denominations Given to Each Player |
|---|---|
| 1 | 10 |
| 5 | 10 |
| 10 | 5 |
| 20 | 5 |
| 50 | 2 |
| 100 | 1 |

Wager betting limits for each game are set by the players. Three different sets of vouchers, i.e., $1, $2 and $5 sets are provided. Each set consists of eight colors corresponding to the eight tracks on the game board. For example, if the limit is set at $1, the player can buy as many vouchers as he or she wants to buy and can play as many horses as he or she wants to play. The vouchers keep tabs on the bets. Each bet is recorded on the tally board as they are sold. A player may bet on more than one game piece (i.e., color). Some examples include the following:

If a player bets $1 on green, he is given a $1 green voucher and a mark is made in the green line of the tally board.

If a player bets $2 on red, he is given a $2 red voucher or two $1 red vouchers and two markers are provided in the red line of the tally board.

If a player bets $3 on blue, he is given a $1 blue voucher and a $2 blue voucher or three $1 blue vouchers and three marks are entered in the blue line of the tally board.

After all vouchers are sold and recorded the money is collected and placed in the pot. The number of markers for each color is counted and the amount of money in the pot is divided by that number to provide the odds paid on that color. For example, if there are six (6) check marks on the color green and there is $60 in the pot, $60 divided by 6 equals $10 meaning that green pays $10 for each $1 bet. Tallies are made for each color and the odds are recorded on the tally board.

It should be noted that the number of players can be greater or lesser than the number of game pieces, thus enabling the game to accommodate a large number of players, if desired, regardless of the set number of game pieces.

What is claimed is:

1. A game board comprising:

a plurality of track support members and spacer members arranged in parallel fashion, wherein spacer members are provided between adjacent track support members;

each track support member being an elongated hollow support member with a substantially U-shaped cross-section and an exterior top surface portion configured to freely and slidably support a game piece;

each game piece having a base member configured to slide in a given direction horizontally along the exterior top surface portion of the track support member;

a cooperating member piece placed inside each hollow support member and being configured to slide along a horizontal interior surface portion parallel to the exterior top surface portion of said track support member;

said interior surface portion being spaced from two opposite vertical sides of the associated hollow support member, whereby only a central portion of a bottom surface of each cooperating member piece slidably engages said horizontal interior surface portion;

the opposite vertical sides of each hollow support member being configured to limit movement of its associated cooperating member in a direction transverse to said given direction;

said cooperating member piece and said base member being configured to attract one another by a magnetic force whereby each base member is retained on its associated track by said cooperating member and whereby said magnetically attractive force causes said cooperating member piece to move when said game piece is moved along its associated track.

2. The game board of claim 1 wherein said base member and said cooperating member are permanent magnets.

3. The game board of claim 1 wherein one of said base members and said cooperating members is a permanent magnet and a remaining one of said base members and said cooperating members is formed of a magnetically attractive material.

4. The game board of claim 1 wherein said cooperating member is a disk-shaped member.

5. The game board of claim 1 wherein each support member is formed of a suitable plastic material.

6. The game board of claim 1 wherein each support member is configured to position the interior surface supporting said cooperating member in close proximity to said track to facilitate the magnetic attraction between a cooperating member and its associated base member.

7. The game board of claim 6 wherein each cooperating member has a circular shape, a width of the surface portion supporting an associated cooperating member measured in said traverse direction being less than a diameter of said cooperating member.

8. The game board of claim 1 wherein each hollow support member is provided at both open ends thereof with means for preventing the cooperating member which has no connection to any driving device and is freely slidable in said hollow support member when the magnetic attracts the associated game piece is removed, from falling out of its associated tubular member.

9. The game board of claim 1 wherein said game board hollow support members are divided into sections;

elongated members being configured to be force-fitted into a portion of said hollow members of said sections to join said sections to form a complete game board.

10. The game board of claim 1 wherein elongated sides of said members are joined together to form said game board.

11. The game board of claim 1 wherein said spacer members are configured to act as guides limiting lateral movement of said game pieces along their respective tracks.

12. The game board of claim 1 wherein side surfaces of adjacent support members are joined to one another.

13. The game board of claim 12 wherein said side surfaces of adjacent support members are joined employing one of a suitable adhesive, epoxy, glue and joining clips.

* * * * *